US007287818B1

(12) United States Patent
Hall et al.

(10) Patent No.: US 7,287,818 B1
(45) **Date of Patent: *Oct. 30, 2007**

(54) VERTICAL MILLING APPARATUS FOR A PAVED SURFACE

(76) Inventors: David R. Hall, 2185 S. Larsen Pkwy., Provo, UT (US) 84606; Timothy C. Duke, 2185 S. Larsen Pkwy., Provo, UT (US) 84606; Joe Fox, 2185 S. Larsen Pkwy., Provo, UT (US) 84606; Tyson J. Wilde, 2185 S. Larsen Pkwy., Provo, UT (US) 84606

( * ) Notice: Subject to any disclaimer, the term of this patent is extended or adjusted under 35 U.S.C. 154(b) by 0 days.

This patent is subject to a terminal disclaimer.

(21) Appl. No.: 11/381,720

(22) Filed: May 4, 2006

(51) Int. Cl.
*E01C 23/00* (2006.01)

(52) U.S. Cl. ..... 299/41.1

(58) Field of Classification Search ..... 299/41.1
See application file for complete search history.

(56) References Cited

U.S. PATENT DOCUMENTS

| | | | | |
|---|---|---|---|---|
| 513,708 | A * | 1/1894 | Henderson | 299/41.1 |
| 1,812,771 | A * | 6/1931 | Blood et al. | 299/41.1 |
| 3,219,390 | A * | 11/1965 | Conner | 299/41.1 |
| 3,361,042 | A | 1/1968 | Cutler | |
| 3,732,023 | A | 5/1973 | Rank | |
| 3,970,404 | A | 7/1976 | Benedetti | |
| 3,989,401 | A | 11/1976 | Moench | |
| 4,018,540 | A | 4/1977 | Jackson | |
| 4,104,736 | A | 8/1978 | Mendenhall | |
| 4,124,325 | A | 11/1978 | Cutler | |
| 4,172,679 | A | 10/1979 | Wirtgen | |
| 4,195,946 | A | 4/1980 | Swishor | |
| 4,335,975 | A | 6/1982 | Schoolkopf | |
| 4,347,016 | A | 8/1982 | Sindelar | |
| 4,407,605 | A | 10/1983 | Wirtgen | |
| 4,453,856 | A | 6/1984 | Chiostri | |
| 4,458,949 | A * | 7/1984 | Jury | 299/41.1 |
| 4,473,320 | A | 9/1984 | Register | |
| 4,534,674 | A | 8/1985 | Cutler | |
| 4,594,022 | A | 6/1986 | Jeppson | |
| 4,668,017 | A | 5/1987 | Petersen | |
| 4,676,689 | A | 6/1987 | Yant | |
| 4,784,518 | A | 11/1988 | Cutler | |
| 4,793,730 | A | 12/1988 | Butch | |
| 4,904,024 | A * | 2/1990 | Wiley | 299/39.6 |
| 4,968,101 | A | 11/1990 | Bossow | |
| 5,366,320 | A | 11/1994 | Hanlon | |
| 5,556,225 | A | 9/1996 | Marino | |
| 5,765,926 | A * | 6/1998 | Knapp | 299/39.3 |
| 5,791,814 | A | 8/1998 | Wiley | |
| 6,158,920 | A | 12/2000 | Malot | |
| 6,269,894 | B1 * | 8/2001 | Griffin | 175/434 |
| 6,371,689 | B1 | 4/2002 | Wiley | |
| 6,623,207 | B2 | 9/2003 | Grubba | |
| 6,769,836 | B2 | 8/2004 | Llyod | |

(Continued)

*Primary Examiner*—John Kreck
(74) *Attorney, Agent, or Firm*—Tyson J Wilde

(57) ABSTRACT

A vertical milling apparatus for a paved surface has a rotary degradation element which has a top end connected to a carrier. The carrier is slideably attached to an underside of a motorized vehicle, and adapted to traverse the paved surface. The rotary degradation element has an axis of rotation and a plurality of inserts secured to the element's outer surface. At least one insert has a superhard working surface positioned to contact the paved surface.

25 Claims, 19 Drawing Sheets

U.S. PATENT DOCUMENTS

2003/0127904 A1* 7/2003 Due ..... 299/18
2006/0196698 A1* 9/2006 Hall et al. ..... 175/327
2006/0198697 A1* 9/2006 Hall et al. ..... 404/75
2006/0198698 A1* 9/2006 Hall et al. ..... 404/75
2006/0198699 A1* 9/2006 Hall ..... 404/77
2006/0198701 A1* 9/2006 Hall et al. ..... 404/91
2006/0198702 A1* 9/2006 Hall et al. ..... 404/93
2006/0198703 A1* 9/2006 Hall et al. ..... 404/94

* cited by examiner

VERTICAL MILLING APPARATUS FOR A PAVED SURFACE

BACKGROUND OF THE INVENTION

In the transportation industry, more emphasis has been put on recycling paved surfaces because of environmental concerns and the need to conserve natural resources. Perhaps because of that emphasis, asphalt has become the most recycled material in the United States. Typically, more than 70 million metric tons are recycled every year. Using recycled materials for roads is important to citizens, cities, and states throughout the country because it may be more convenient and may save time and money.

Due to advances in mechanical and chemical engineering, it is now possible to recycle paved surfaces in situ. Methods for in situ recycling are known as hot in-place recycling and cold in-place recycling and share the steps of degrading, rejuvenating, and compacting the old roads. One problem that may occur during recycling is that the aggregate in the old road is broken. Aggregate size is an important characteristic of a road because it influences stiffness, stability, durability, permeability, workability, fatigue resistance, frictional resistance, and resistance to moisture damage. If the aggregate is broken while recycling, new aggregate may be required to ensure the asphalt's characteristics remain substantially unchanged. This may require the purchase of new aggregate and special or modified machinery to load and distribute new aggregate which may add to the time and money spent on recycling and reconstructing a road.

BRIEF SUMMARY OF THE INVENTION

In one aspect of the invention, a vertical milling apparatus for a paved surface comprises a rotary degradation element comprising a top end. The top end may be connected to a carrier which is slideably attached to an underside of a motorized vehicle, and adapted to traverse the paved surface. The rotary degradation element comprises an axis of rotation and a plurality of inserts which may be secured to the element's outer surface. At least one insert comprises a superhard working surface positioned to contact the paved surface.

DETAILED DESCRIPTION OF THE INVENTION AND THE PREFERRED EMBODIMENT

It will be readily understood that the components of the present invention, as generally described and illustrated in the Figures herein, may be arranged and designed in a wide variety of different configurations. Thus, the following, more detailed description of embodiments of the apparatus of the present invention, as represented in the Figures is not intended to limit the scope of the invention, as claimed, but is merely representative of various selected embodiments of the invention.

The illustrated embodiments of the invention will best be understood by reference to the drawings, wherein like parts are designated by like numerals throughout. Those of ordinary skill in the art will, of course, appreciate that various modifications to the apparatus described herein may easily be made without departing from the essential characteristics of the invention, as described in connection with the Figures. Thus, the following description of the Figures is intended only by way of example, and simply illustrates certain selected embodiments consistent with the invention as claimed herein.

In this application, the terms "pavement" and "paved surface" are used interchangeably and refer to any artificial, wear-resistant surface that facilitates vehicular, pedestrian, or other form of traffic. Pavement may include composites containing oil, tar, tarmac, macadam, tarmacadam, asphalt, asphaltum, pitch, bitumen, minerals, rocks, pebbles, gravel, polymeric materials, sand, polyester fibers, Portland cement, petrochemical binders, or the like. Likewise, rejuvenation materials refer to any of various binders, oils, and resins, including bitumen, surfactant, polymeric materials, wax, zeolite, emulsions, asphalt, tar cement, oil, pitch, or the like. Reference to aggregates refers to rock, crushed rock, gravel, sand, slag, sol, cinders, minerals, or other coarse materials, and may include both new aggregates and aggregates reclaimed from an existing road.

Figure 1:
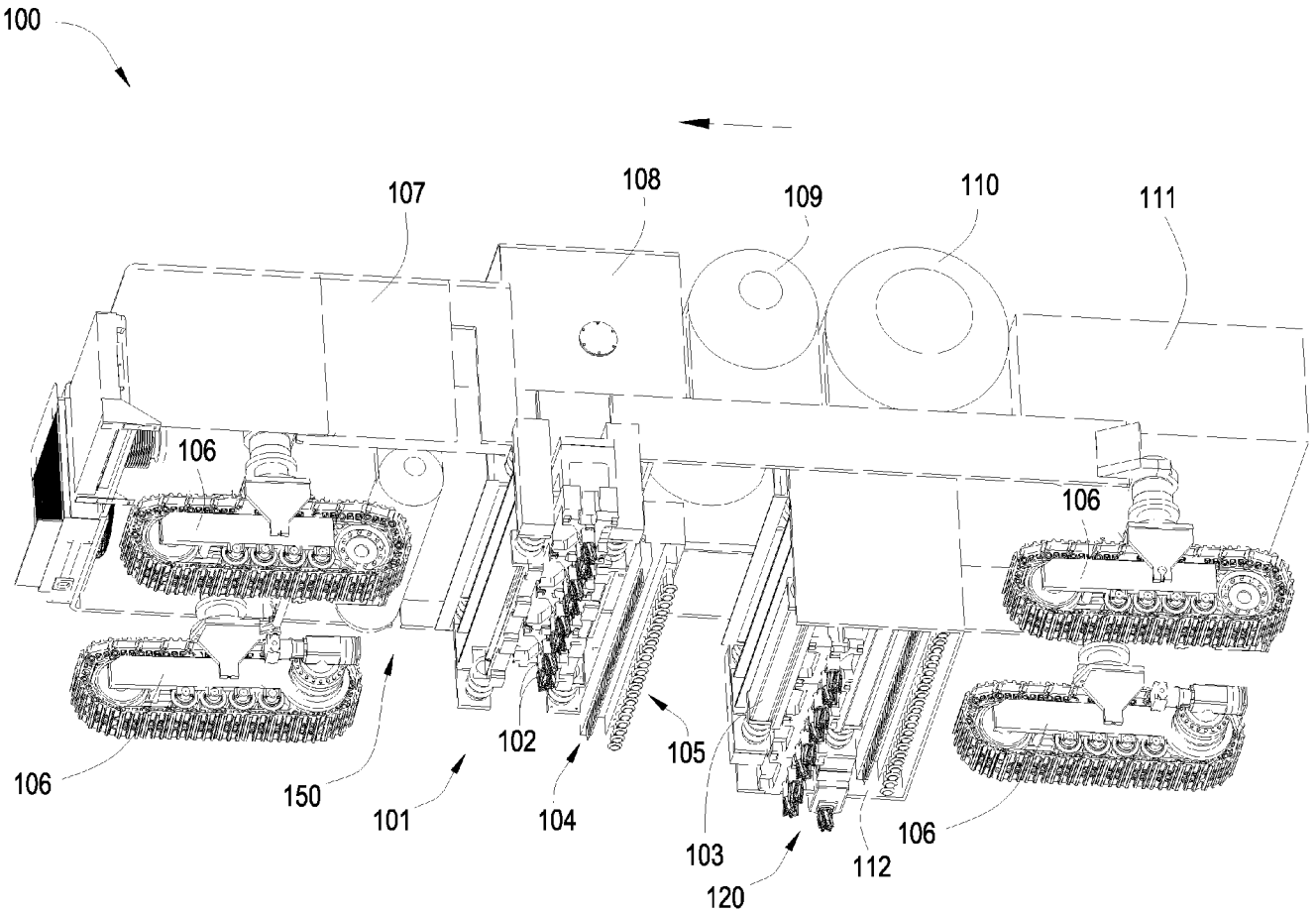
FIG. 1 is a perspective view of an embodiment of a pavement recycling machine.

FIG. 1 is a perspective view of an embodiment of a pavement recycling motorized vehicle 100. The motorized vehicle 100 may be a motor vehicle adapted to degrade, recycle, and reconstruct pavement. The motorized vehicle 100 may comprise at least one carrier 101 slidably attached to its underside 150 to which at least one rotary degradation element 102 may be connected by a shaft substantially coaxial with the degradation element's axis of rotation. The carrier 101 may be slideable and adapted to traverse the paved surface.

At least one rotary degradation element 102 may comprise an axis of rotation, which may be substantially perpendicular to the paved surface. In some embodiments, the axis of rotation may intersect the paved surface at 30 to 150 degrees. A plurality of inserts may be secured to the element's 102 outer surface and at least one insert may comprise a superhard working surface positioned to angularly contact the paved surface at an incline. The carrier 101 may comprise or be in communication with actuators 103 such as hydraulic cylinders, pneumatic cylinders, or other mechanical devices adapted to move the carrier 101. Each carrier 101 may also comprise a screed 104 to level, smooth, and mix pavement aggregates and/or rejuvenation materials. Additionally, the carrier 101 may comprise a compacting mechanism 105. Such a mechanism 105 may comprise rollers, tampers, tires, or combinations thereof. Additionally, a second carrier 120 may be added to the vehicle 100 which may increase degradation efficiency and speed.

There may also be a shield 112 comprising a first end attached to a carrier 101, 120 and a second end proximate the rotary degradation element 102. Although the shield 112 is shown in FIG. 1 with an open side, the shield may form a complete box around all of the elements connected to the carrier. The bottom of the shield 112 may extend until it almost contacts the pavement so as to minimize the possibility that a random piece of aggregate may be projected away from the motorized vehicle. The inside surface of the shield 112 may also comprise a reflective surface which may be useful for maintaining the environment at which the elements degrade pavement within a desired range such as 100 to 275 degrees Fahrenheit. The shield 112 may also be useful for maintaining a reduced or inert environment in which the aggregate and rejuvenation material may be bonded together. The shield 112 may be made of a metal or a heavy fabric.

The motorized vehicle 100 may comprise a translation mechanism 106 such as tracks and/or tires. In some embodiments, each translation mechanism 106 may be adapted to turn enabling the motorized vehicle to maneuvers around sharp corners. The carrier 101 may be between the translation mechanisms 106. The vehicle 100 may also comprise a shroud 107 to cover various internal components such as engine and hydraulic pumps, the carriers 101, 120; the plurality of rotary degradation elements 102; or other components. The motorized vehicle 100 may also comprise a tank 108 for storing hydraulic fluid, a fuel tank 109, a tank 110 for storing rejuvenation materials, a hopper 111 for storing aggregate, or combinations thereof.

As the motorized vehicle 100 traverses a paved surface, the plurality of rotary degradation elements 102 may be adapted to degrade the paved surface in a direction substantially normal to the paved surface. As the elements 102 rotate and degrade the pavement, they may do so in a manner that dislodges aggregate from the asphalt binder without breaking and/or damaging the aggregate. Additional aggregate and rejuvenation materials may be laid down in front of, between, or after the rotary degradation elements 102 so that the elements 102 at least partially mix the aggregate, asphalt binder, and rejuvenation materials (collectively referred to as "the mix") together. The screed 104 may then also partially stir the mix in addition to leveling and smoothing it. The compacting mechanism 105 may follow the screed 104 and compact the mix. In this manner old road materials may be recycled and used to lay a new road using a single motorized vehicle 100.

Figure 2:
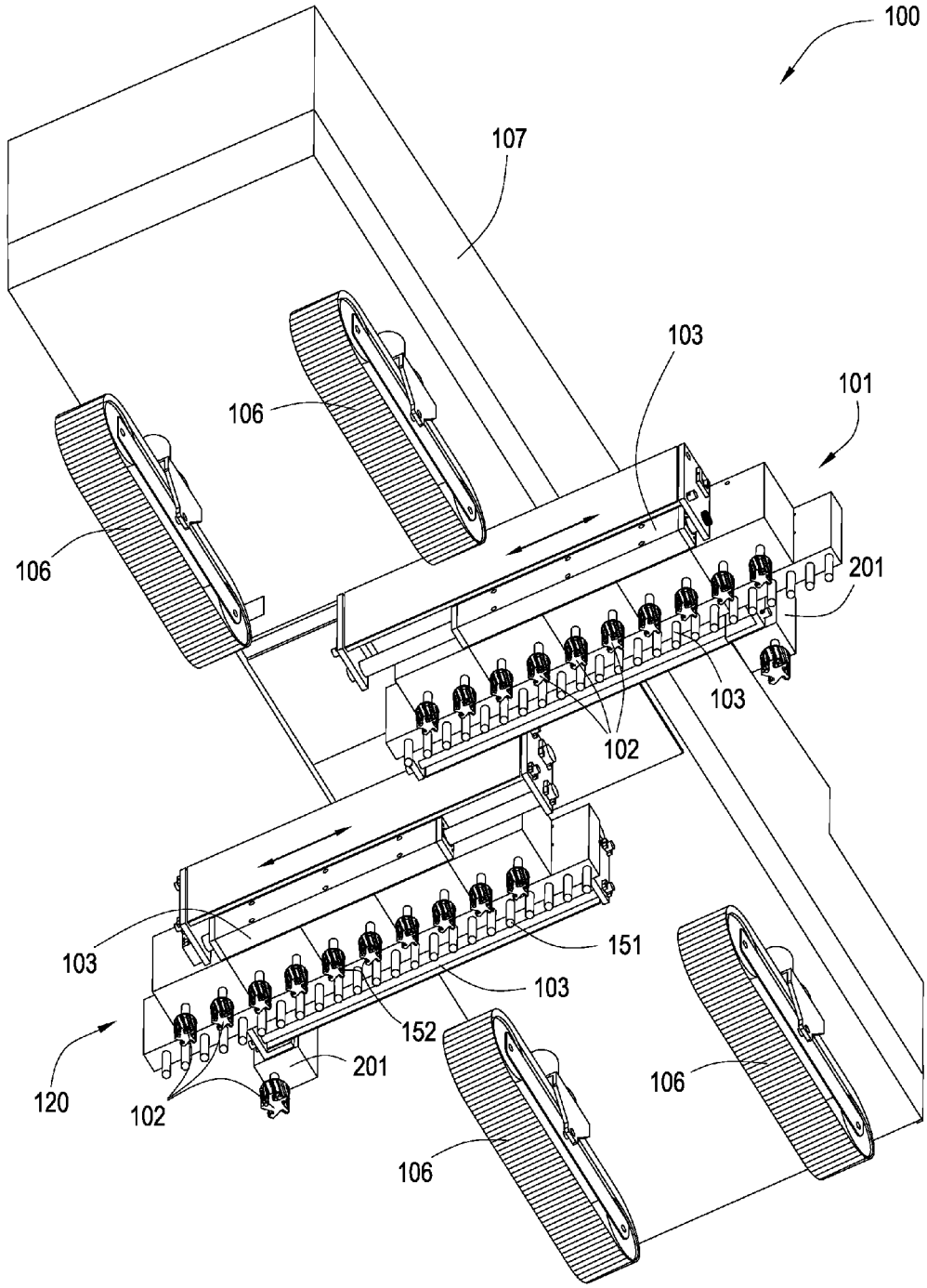
FIG. 2 is bottom perspective view of an embodiment of a pavement recycling machine.

FIG. 2 is bottom perspective view of an embodiment of a pavement recycling motorized vehicle 100. The carriers 101, 120 may be between the elements of the translation mechanism 106 and have actuators 103 that move them. Here, the carriers 101, 120 may move laterally to either side. This may be beneficial in that at least one lane, or perhaps more than one lane, may be recycled and reconstructed in a single pass, thus saving time and money. The lateral movement of the carriers 101, 120 may also be beneficial in the degradation process. If the carrier 101 travels in a straight line, pavement between the rotary degradation elements 102 may not be degraded because there may be space between them. Moving the carriers 101, 120 laterally may allow the elements 102 to degrade a wide paved surface without leaving areas that are not degraded. Additionally, so no pavement is left undegraded, the distance that the rotary degradation elements 102 move forward may not exceed the diameter of the elements 102 during a cycle. A cycle is carrier movement from point A to point B and back to A. Thus, in some embodiments, as a carrier 101 extends laterally and retracts to its original position, the forward distance traversed may not exceed the diameter of the elements 102; otherwise pavement may be left undegraded. Alternatively, the carriers 101, 120 may be positioned such that the first carrier's 101 elements 102 degrade pavement and the second carrier 120 is offset so that its elements 102 degrade what the first carrier's 101 elements 102 did not. A carrier 101 may also comprise two rows of elements 102, each row being offset from the other, to degrade the entire pavement as the carrier 101 passes over. Preferably the aggregate are dislodged individually from the asphalt binder so that the entire surface area for each aggregate may be exposed to the rejuvenation material. In some embodiments, a fixture 151 may be positioned between the degradation elements 102 to restrict the area 152 between elements 102 and limit the possibility of two or more aggregate bonded together passing between the degradation elements 102.

A trimming tool 201 that may comprise at least one rotary degradation element 102 may be connected to the carrier 101. The trimming tool 201 may be beneficial in that it may degrade pavement that conventional machines using traditional methods have not been able to. Using the trimming tool 201 may eliminate the need for a worker or a smaller vehicle to follow the motorized vehicle 100 degrading pavement left undegraded. For example, as the degradation elements 102 move laterally across the pavement, they may leave a jagged edge, which the trimming tool 201 may trim.

Figure 3:
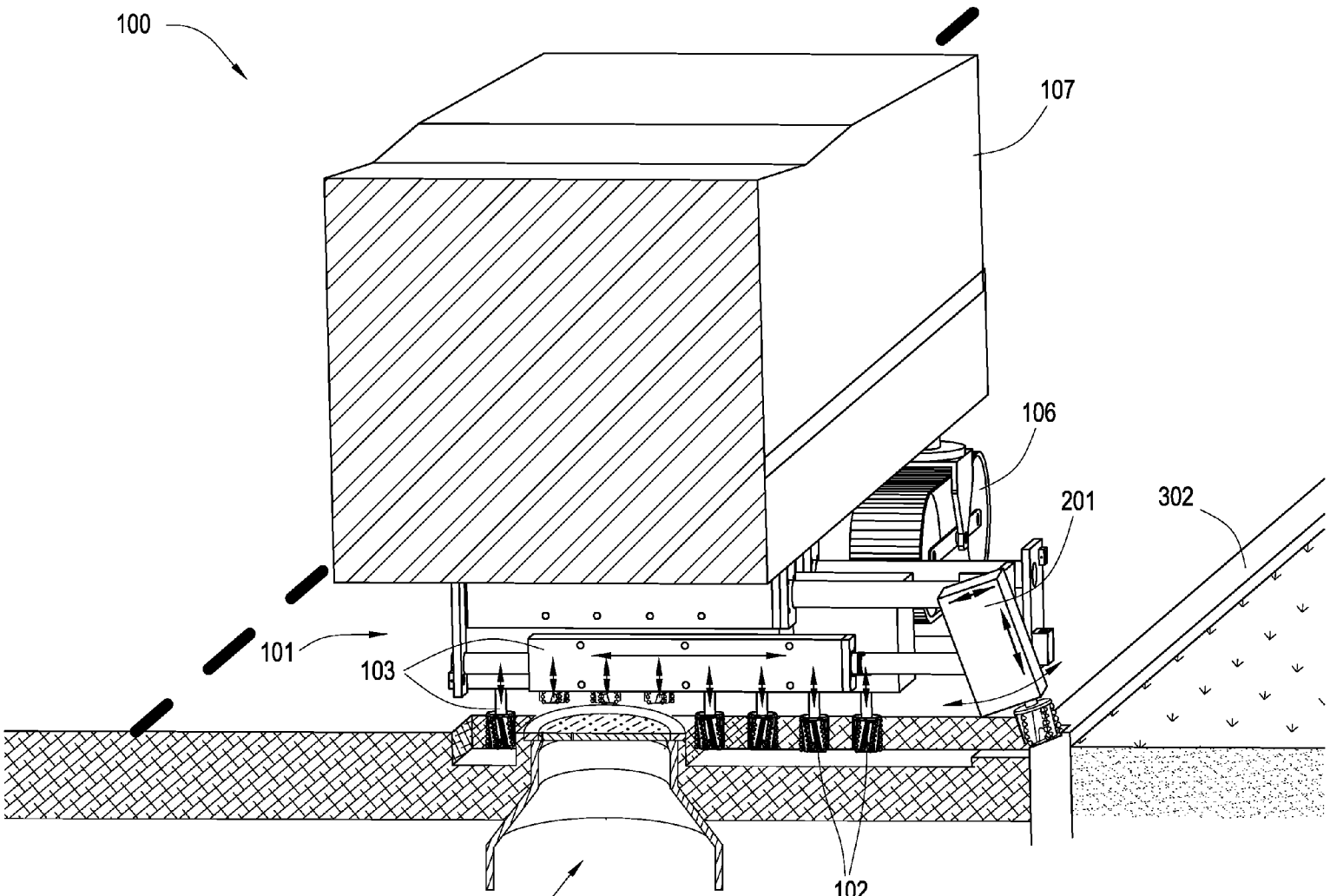
FIG. 3 is a cutaway perspective view showing vertical movement of the rotary degradation elements, and the contemplated movements of the carrier.

FIG. 3 is a cutaway perspective view showing vertical movement of the rotary degradation elements 102, and the contemplated movements of the carrier 101 and rotary degradation elements 102. Obstacles, including manholes 301, utility boxes, utility access points, sensors, curbs 302, or combinations thereof, may sometimes be in the way when degrading, recycling, and reconstructing a road. Some machines may need to stop degrading or recycling until the machine has advanced beyond the obstacle. Other machines may pave over the obstacle which workers may later uncover. The rotary degradation elements 102, however, may be capable of vertical movement which may enable the elements 101 that would engage the obstacle to rise until they have passed over the obstacle while the other elements 102 continue to degrade around the obstacle.

The elements 102 may be capable of more movement other than just vertical movement. An element 102 may be in communication with an actuating mechanism 103 adapted to move the rotary degradation element 102 in a horizontal, vertical, transverse, diagonal, and pivotal direction independent of and relative to the vehicle 100.

Figure 4:
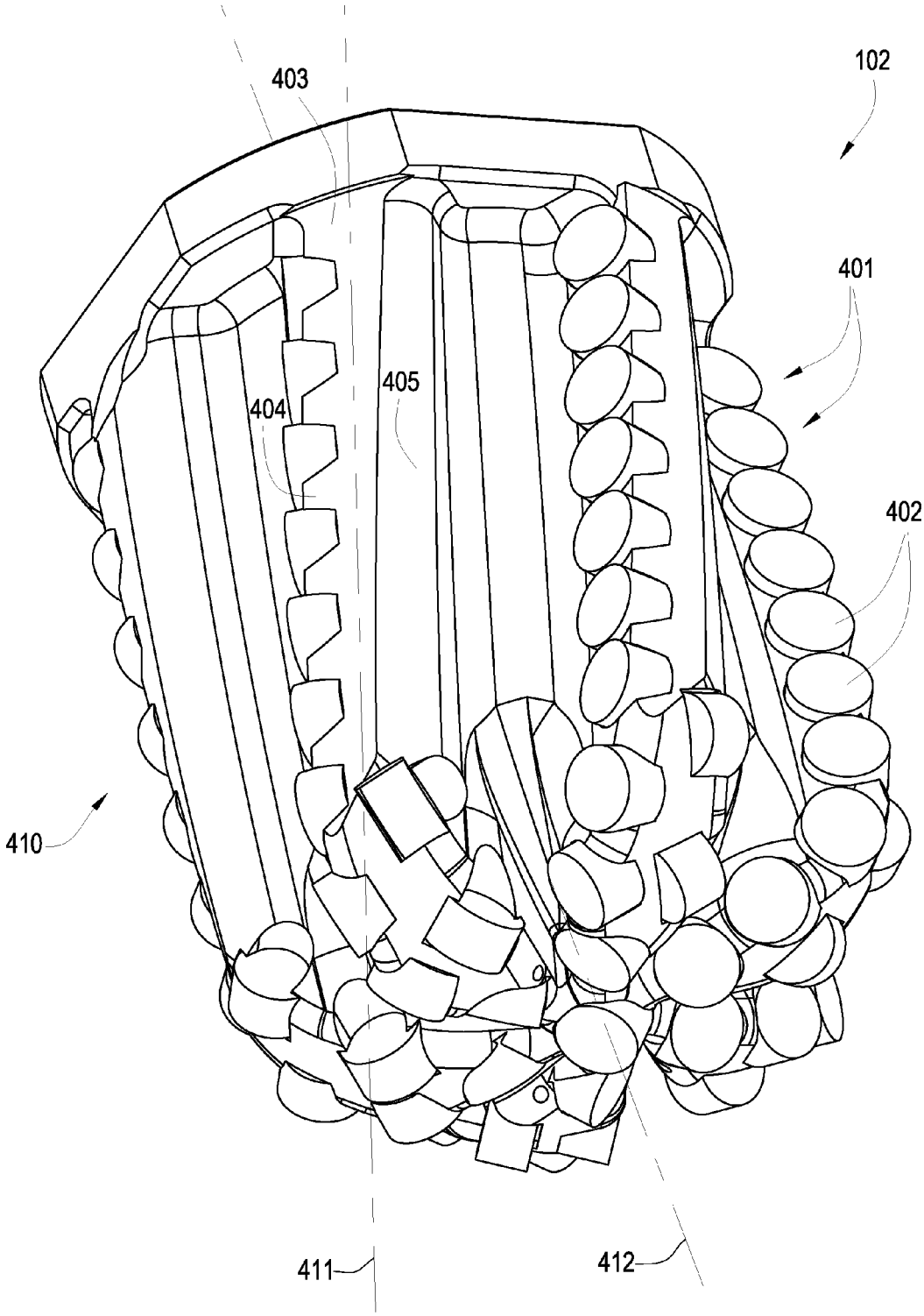
FIG. 4 is a side perspective view of an embodiment of a rotary degradation element.
Figure 5:
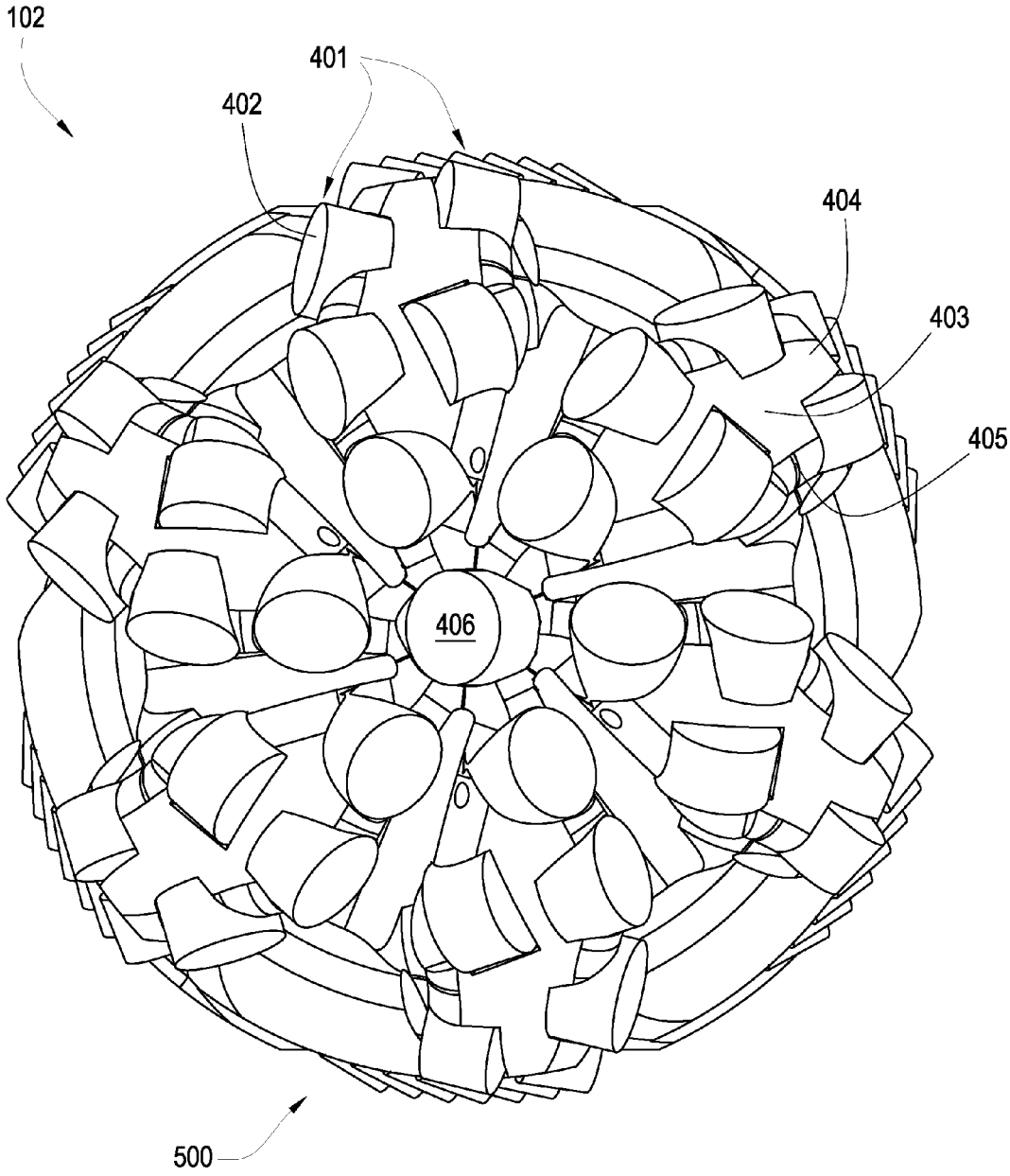
FIG. 5 is a bottom perspective view of an embodiment of a rotary degradation element.

FIGS. 4 and 5 are perspective views of an embodiment of a rotary degradation element 102. Referring to FIG. 4, a side perspective view of an embodiment or a rotary degradation element is presented. An important part of pavement recycling is not breaking the aggregate. The rotary degradation element 102 may comprise a plurality of inserts 401 that are secured to the element's 102 outer surface 410, and may be adapted to engage the aggregate and dislodge it without breaking it.

The inserts 401 may be secured to a blade 403 formed in the outer surface 410 of the rotary degradation element 102. An axis 411 formed by at least a portion of at least one blade 403 may be offset from the axis of rotation 412 by an angle from 1° to 60°. The offset may tilt with or against a direction of rotation. At least one of the inserts 401 may be positioned on an anterior side 404 of the blade 403 and another insert 401 may be positioned on a posterior side 405 of the blade 403. The inserts 401 may be brazed to a blade at an incline, specifically an incline that will result in the superhard working surface 402 contacting the pavement at a negative rake angle. The inserts 401 may comprise a superhard working surface 402 comprising polycrystalline diamond, vapor deposition diamond, natural diamond, cubic boron nitride, or combinations thereof. A portion of the superhard working surface 402 may comprise a leached region. In other embodiments, the superhard working surface 402 may be bonded to a substrate with a non-planar interface of the insert.

Referring to FIG. 5, a bottom perspective view of an embodiment of a rotary degradation element 102 is disclosed. At least one bottom insert 406 may be positioned in a bottom end 500 of the rotary degradation element where a plurality of blades 403 converge. A bottom insert 406 may be beneficial in degrading the pavement when the rotary degradation element 102 is plunged into the pavement rather than relying on the weight of the element 102 to break any pavement below its axis. The bottom insert 406 may be positioned perpendicular or parallel to the pavement.

Additionally, the rotary degradation element may comprise a shape that is generally cylindrical, conical, pyramidal, rectangular, frustoconical, domed, spherical, or combinations thereof.

Figure 6:
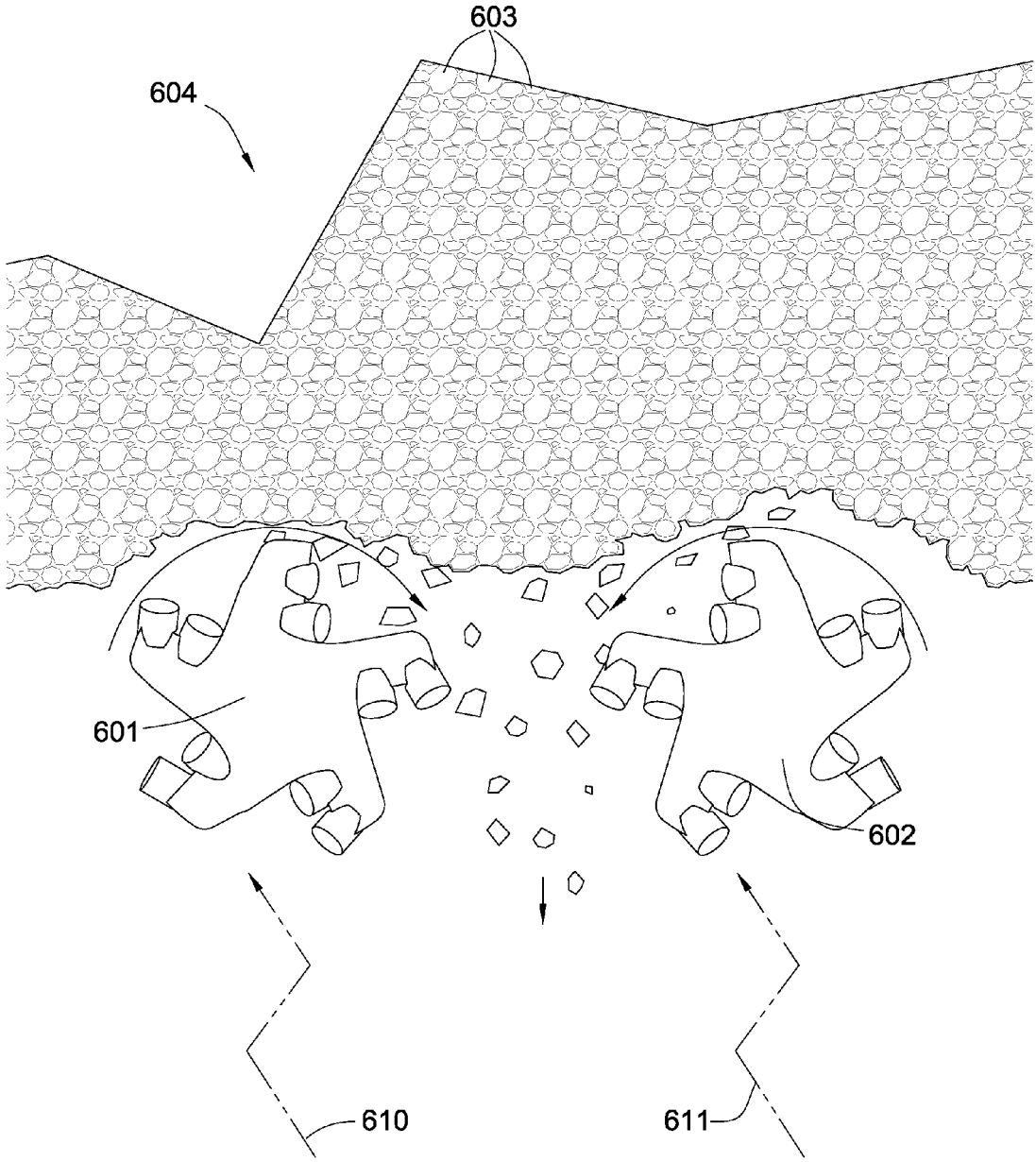
FIG. 6 is a top perspective view of rotary degradation elements engaging pavement.

FIG. 6 is a top perspective view of rotary degradation elements 102 engaging pavement 604. The rotary degradation elements 102 may be designated clockwise rotary degradation elements 601 and counter-clockwise rotary degradation elements 602 according to their rotational direction. The rotational direction is indicated by arrows. While rotating, the elements 102 may move forward to engage the pavement 604. The direction of forward motion is indicated by arrows 610 and 611. The zigzag motion is produced by the combination forward motion of the motorized vehicle 100 and the lateral motion of the carrier 101 and may allow the elements 102 to engage the entire surface of the pavement 604. As the elements 102 move forward, they degrade the asphalt by dislodging pieces of aggregate 603 from the binder which holds the aggregate together.

Numerous motions may be used to degrade the pavement 604. Forward motion may be a straight or diagonal line, and the elements 102 may move counter-clockwise, clockwise, horizontally, vertically, pivotally or combinations thereof.

Figure 7:
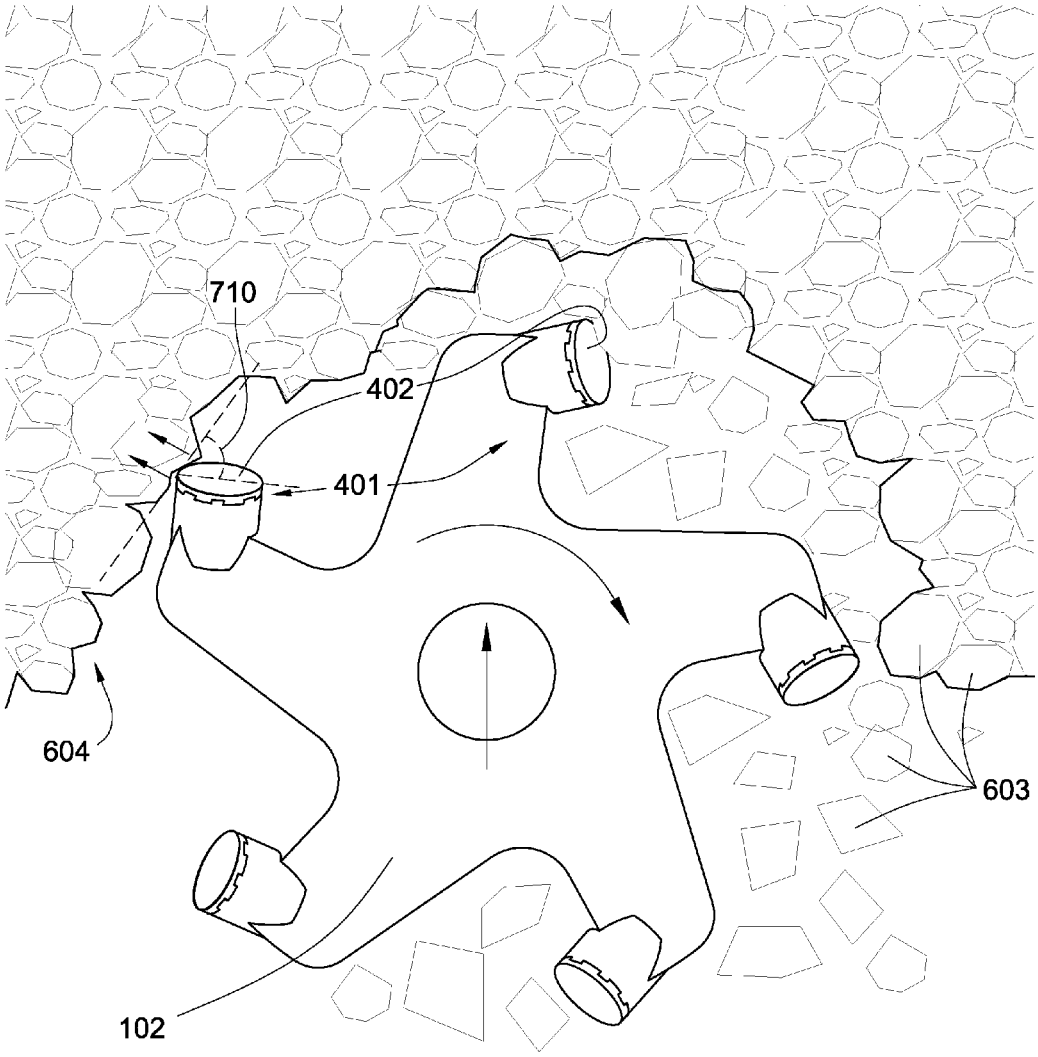
FIG. 7 is a top perspective view of inserts engaging pavement at an incline.

FIG. 7 is a top perspective view of inserts 401 angularly engaging pavement at an incline. The incline may be a negative rake angle 710. A negative rake angle may enable the insert 401 to dislodge a piece of aggregate 603 from the binder without cutting the piece of aggregate 603. The insert 401 may push the aggregate 603 further into the pavement 604 upon an initial contact which may help break the bonds between the aggregate 603 and the binder. Upon successive contacts, the aggregate may be loosened until they are finally dislodged and pushed free from the pavement 603. Dislodging aggregate in this manner may reduce the need to add additional aggregate in order to maintain a proper aggregate size distribution in the mix.

Figure 8:
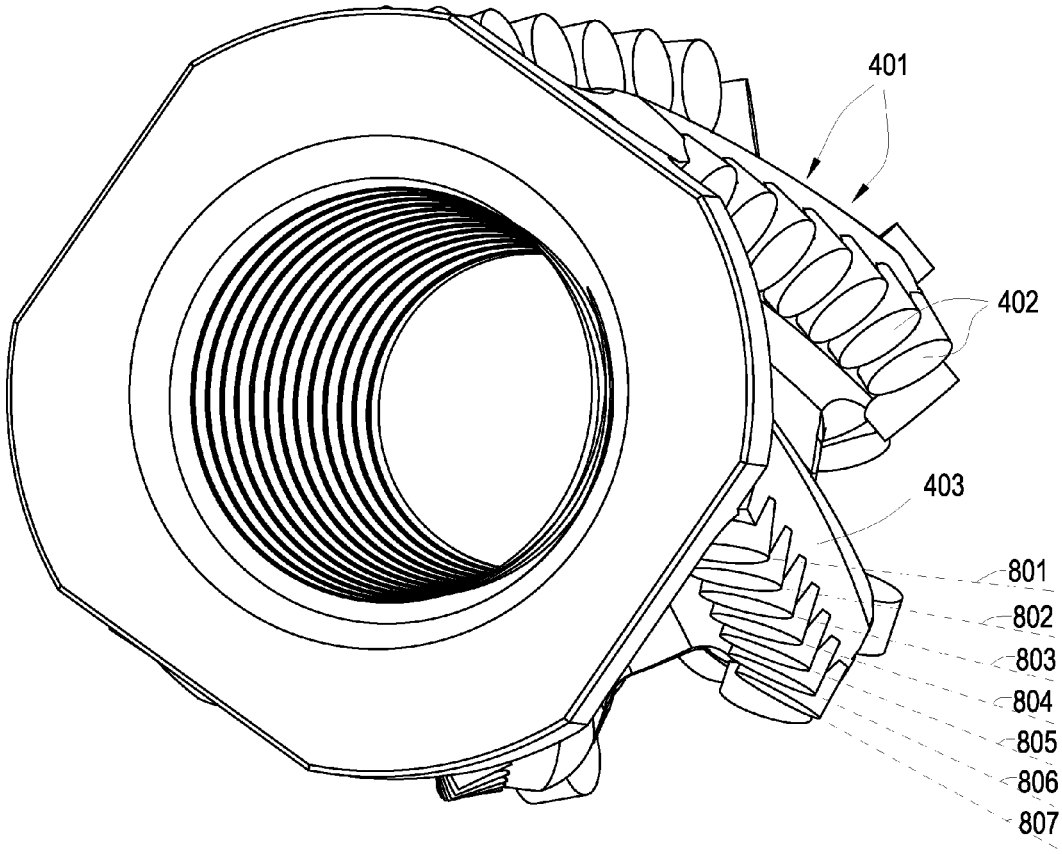
FIG. 8 is a top perspective view of a rotary degradation element with lines showing inserts positioned at various angles.

FIG. 8 is a top perspective view of a rotary degradation element 102 with lines showing the angles at which the plurality of inserts are positioned within the blades of the rotary degradation elements. The angle may not be the same for each insert. The slope of the blades 403, the size of the aggregate pieces, or other factors may determine the needed angles. Lines 801-807 extend from inserts 401 to better show the slope of each working surface 402. The slopes of the inserts 401 may be any negative slopes, preferably from 0.1° to 60°, more preferably 10° to 25°.

Figure 9:
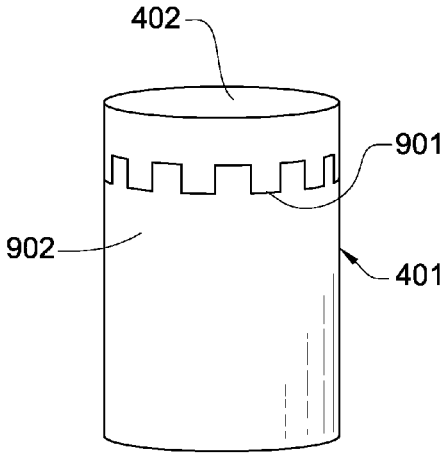
FIG. 9 is a perspective view of an embodiment of an insert.

FIGS. 9-12 are views of various embodiments of inserts. Referring to FIG. 9, a perspective view is disclosed. Inserts 401 may comprise a superhard working surface 402 bonded to a substrate 902 at a non-planar interface 901 which may strengthen the bond between the substrate 902 and the superhard working surface 402. The substrate 902 may be brazed to the outer diameter of the rotary degradation element 102. The substrate 902 may be a cemented metal carbide, preferably a tungsten carbide.

The superhard working surface 402 may comprise a region leached of binder-catalyzing material. When a superhard material, such as polycrystalline diamond, is bonded to a substrate 902, a catalyzing material may be needed for the correct molecular structure to be created. The catalyzing material may be between grains of the superhard material and may impede thermal conduction or weaken the superhard material. Leaching may either remove the catalyzing material or make it inert making the leached region superhard material more tolerant of high heat. Further, the superhard working surface may be flat, rounded, chamfered, polished, or combinations thereof.

The incline and geometry of the inserts may be changed such that the rate of degrading the paved surface may be altered. In some embodiments, it is believed that the slower consistent rate may provide better results than a fast powerful rate, since faster rates may be more prone to damaging the aggregate.

Figure 10:
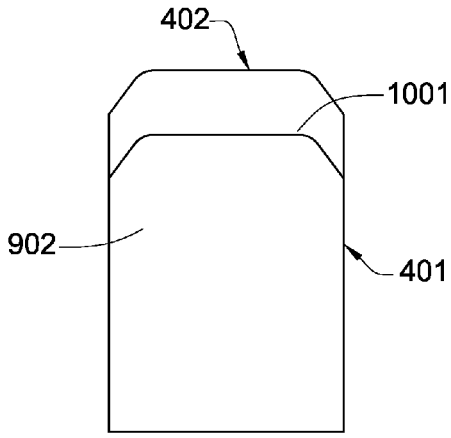
FIG. 10 is a cross-sectional view of an embodiment of an insert with a chamfered edge.
Figure 11:
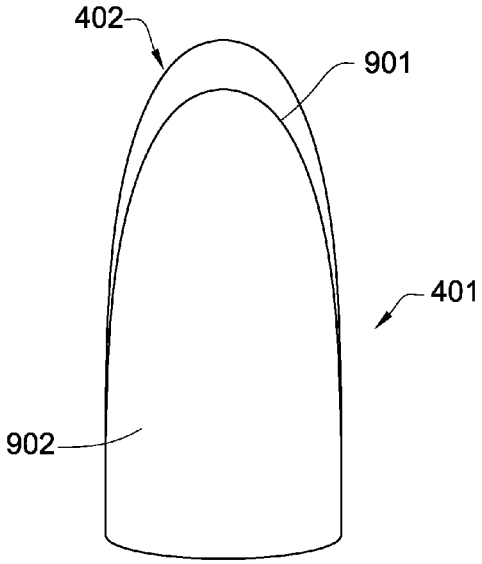
FIG. 11 is a cross-sectional view of another embodiment of an insert.
Figure 12:
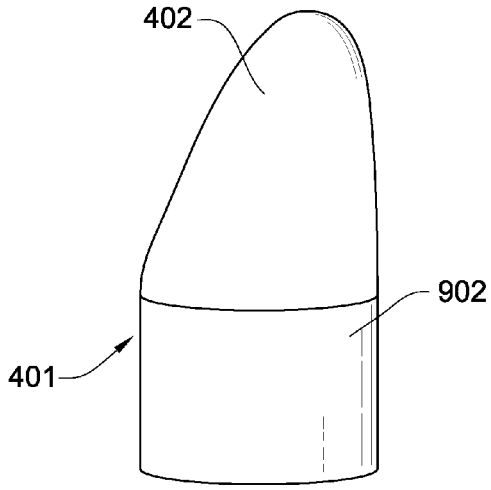
FIG. 12 is a perspective view of another embodiment of an insert.

FIG. 10 is a cross-sectional view of an insert with a chamfered non-planar interface 1001 and edge. FIG. 11 is a cross-sectional view of an insert with a rounded non-planar interface 901 and a rounded superhard working surface 402. A rounded surface 402 may be beneficial in that forces resulting from the insert 401 engaging aggregate 403 may be distributed over a greater area which may be beneficial in dislodging the aggregate 603 without breaking it. FIG. 12 is a perspective view of another embodiment of an insert 401 with a rounded superhard working surface 402.

Figure 13:
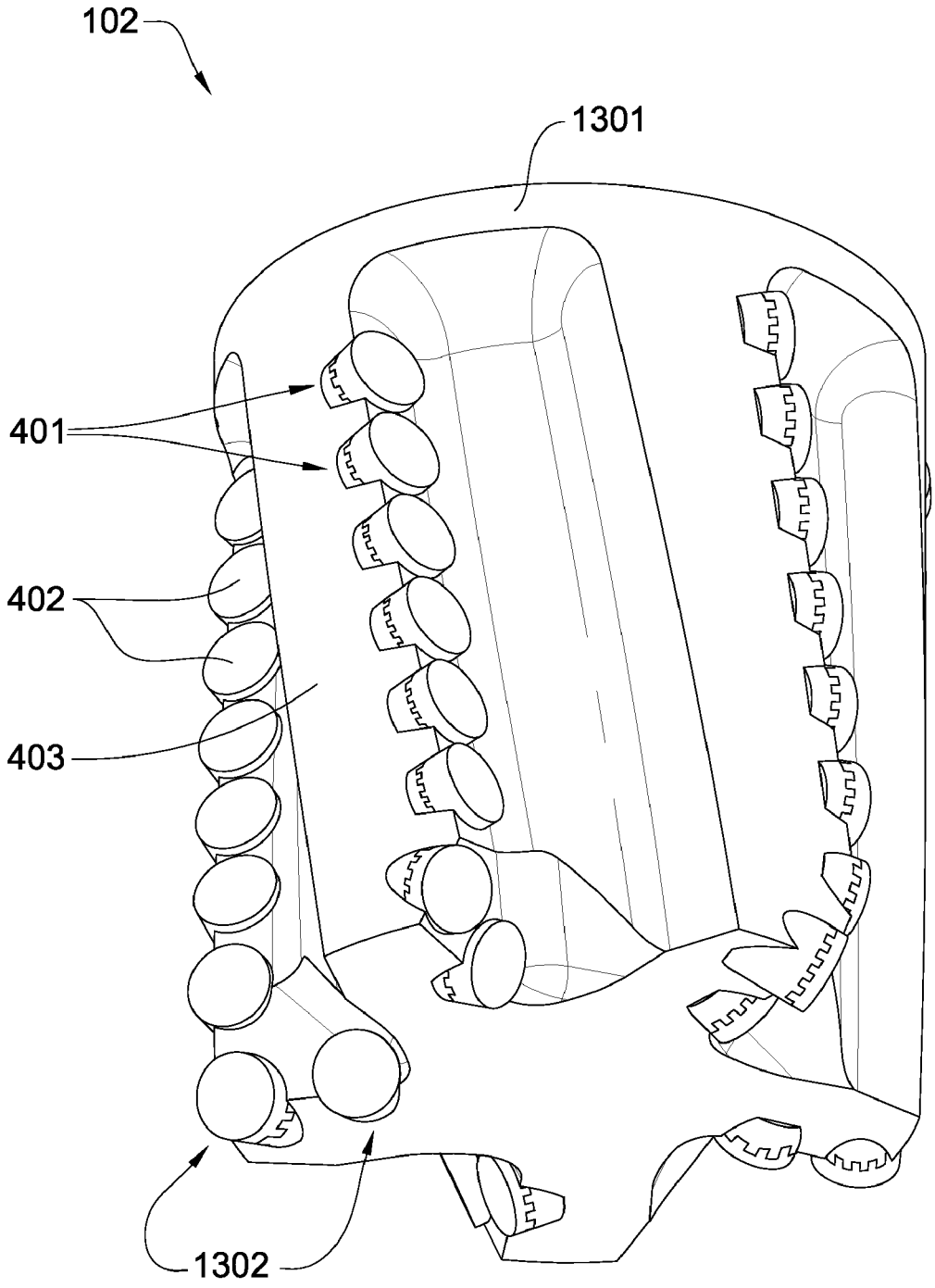
FIG. 13 is a perspective view of another embodiment of a rotary degradation element.

FIG. 13 is a perspective view of another embodiment of a rotary degradation element 102. The element 102 may comprise downward facing inserts 1302 which may aid in plunging the element 102 into pavement 604. Also, the element 102 may comprise a top 1301 that is closed which may keep degraded pavement from jamming the element 102, carrier 101, or actuators 103.

Figure 14:
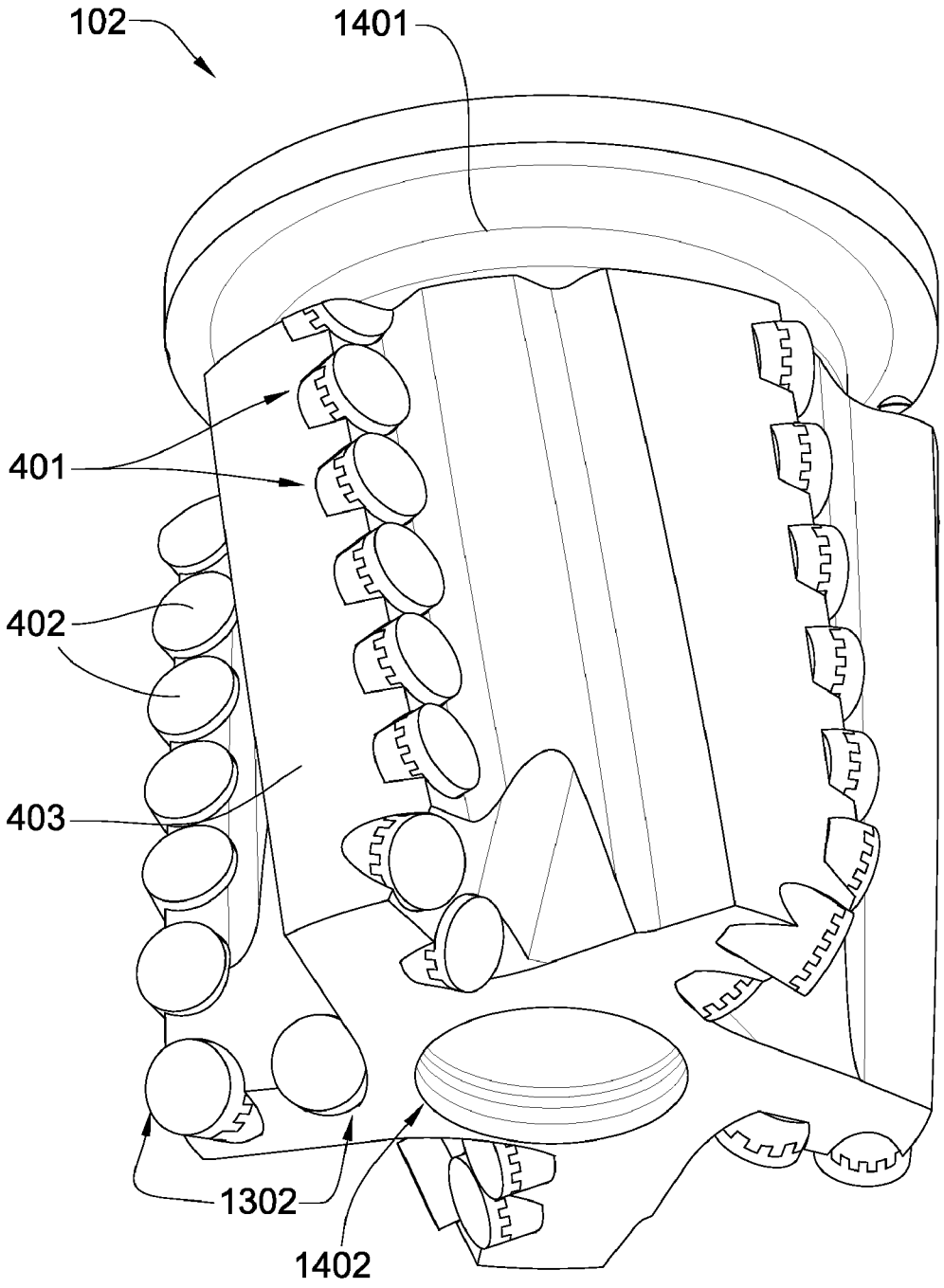
FIG. 14 is a perspective view of another embodiment of a rotary degradation element.

FIG. 14 is a perspective view of another embodiment of a rotary degradation element 102. Elements 102 may include a trough 1401 that may be formed intermediate a plurality of blades 403. This may allow material from move to the top of an element. Also, there may be a passage 1402 in the element 102 through which aggregate and/or rejuvenation materials may pass. By being sent down through the rotary degradation element 102, the aggregate and/or rejuvenation materials may be mixed and distributed into the asphalt mix.

Figure 15:
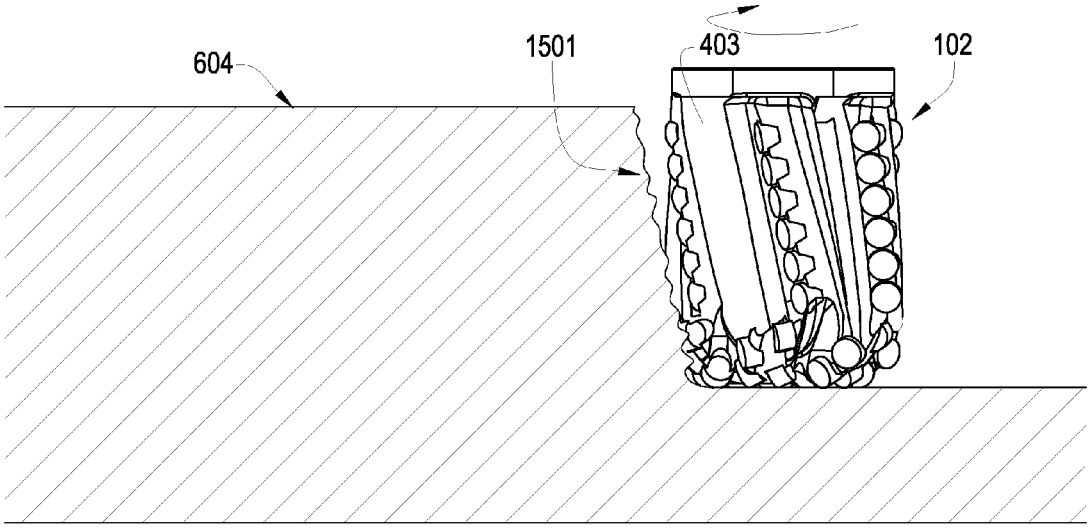
FIG. 15 is a perspective view of an embodiment of a rotary degradation element with blades tilted with a direction of rotation.

FIG. 15 is a perspective view of an embodiment of a rotary degradation element 102 with blades 403 tilted with a direction of rotation. An arrow indicates rotational direction. The inserts 401 of the rotary degradation element 102 may engage the pavement 102 at different times depending on the tilt of the blades 403 and the rotational direction. The blades 403 in FIG. 15 are tilted with the direction of rotation such that the inserts 401 at the top of the element 102 will engage the pavement 604 first resulting in a negative slope 1501 being formed. Such a negative slope may be beneficial in that the resistance each working surface 402 meets may be similar throughout the blade, which may result in more even wear on the working surfaces 402.

Figure 16:
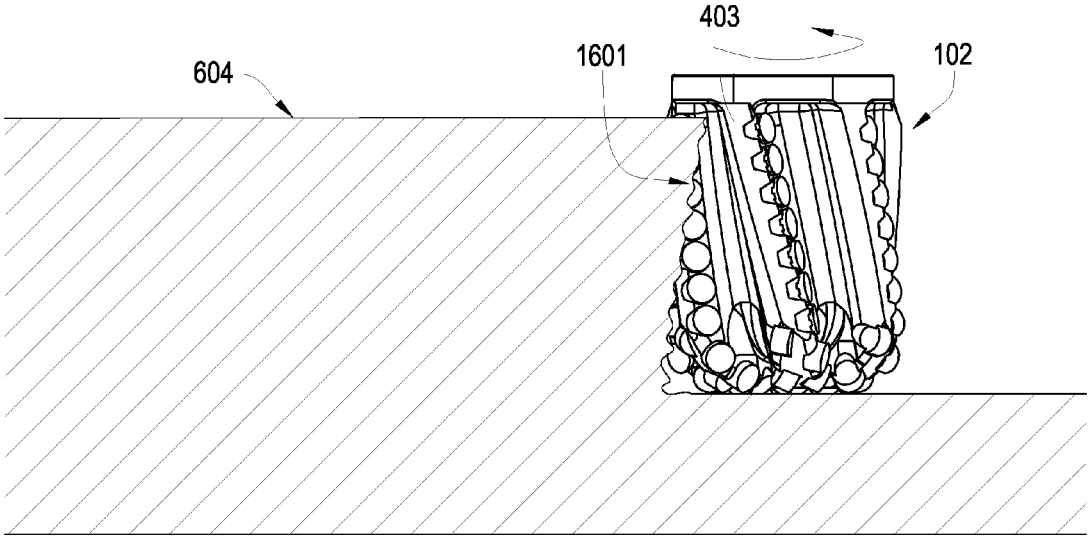
FIG. 16 is a perspective view of an embodiment of a rotary degradation element with blades tilted against a direction of rotation.

FIG. 16 is a perspective view of an embodiment of a rotary degradation element 102 with blades 403 offset behind the axis of rotation. This may result in the inserts 401 at the bottom of the element 102 engaging the pavement 604 first resulting in a positive slope 1601 being formed.

Figure 17:
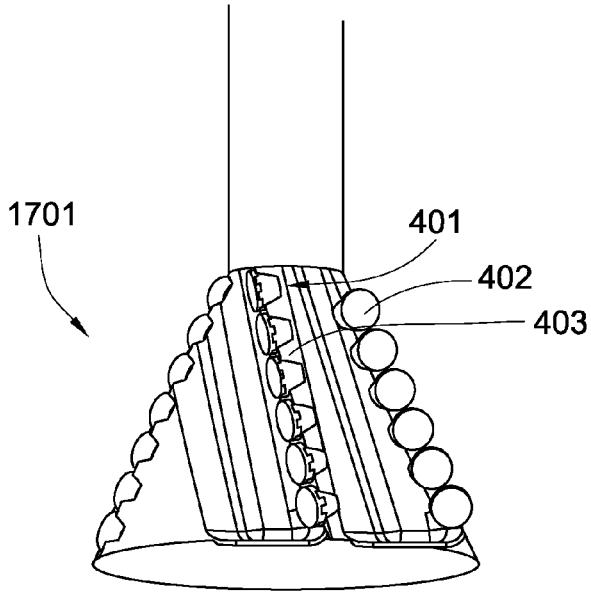
FIG. 17 is a perspective view of another embodiment of a rotary degradation element.
Figure 18:
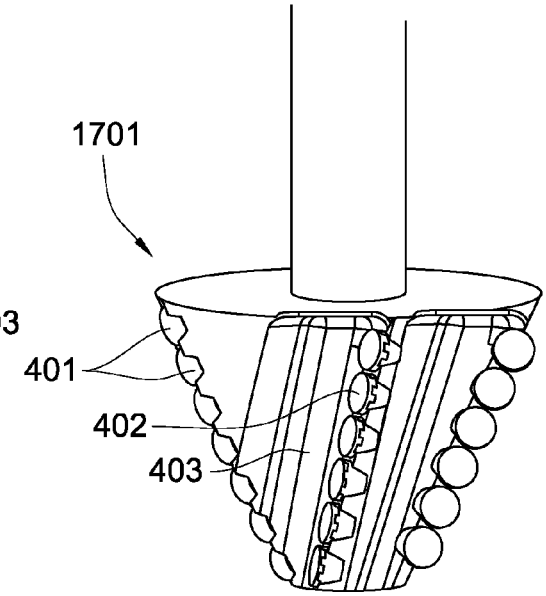
FIG. 18 is a perspective view of another embodiment of a rotary degradation element.
Figure 19:
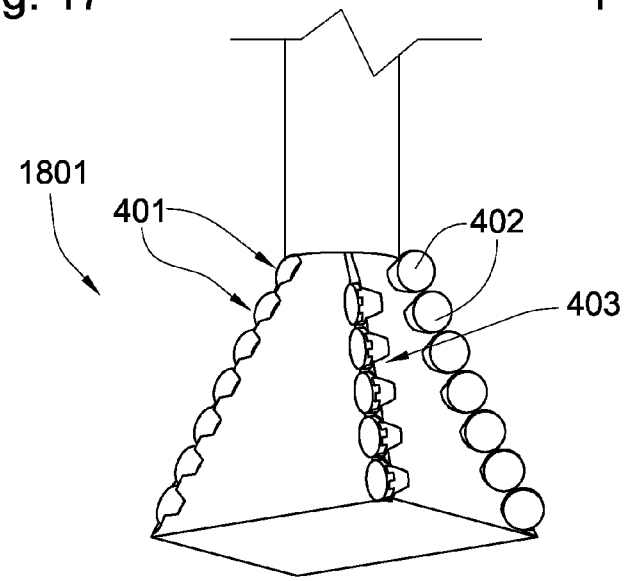
FIG. 19 is a perspective view of another embodiment of a rotary degradation element.
Figure 20:
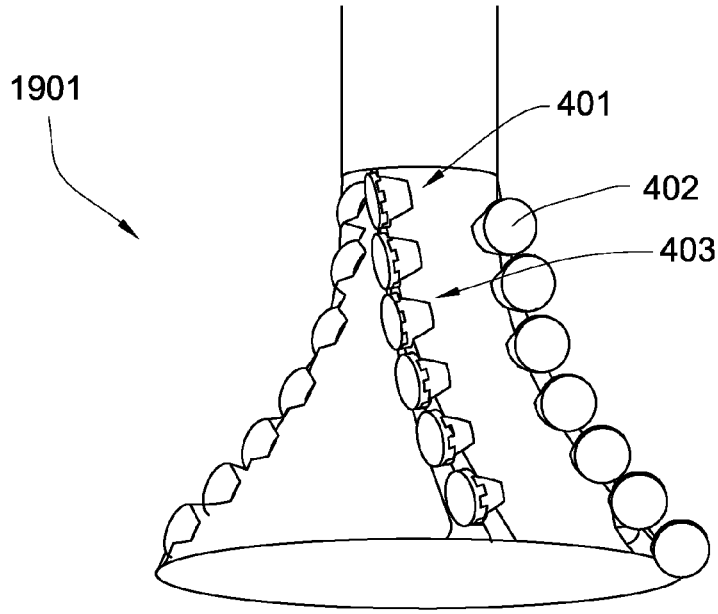
FIG. 20 is a perspective view of another embodiment of a rotary degradation element.

FIGS. 17-20 are views of alternative embodiments of a rotary degradation element 102. FIG. 17 is a perspective view of a conical element 1701 with blades having a positive slope. Controlling the slope and tilt of the element's blades may aid in controlling the resistance faced by the working surfaces 402. FIG. 18 is a perspective view of an element with an upper diameter larger than its lower diameter. FIG. 19 is a perspective view of a pyramidal shaped element 1801. FIG. 20 is a perspective view of an element 1901. These alternative embodiments, along with others, may be tilted to degrade pavement at various angles, increase or decrease efficiency, reach places that a trimming tool 201 or non-tilted elements 102 cannot, or combinations thereof.

Figure 21:
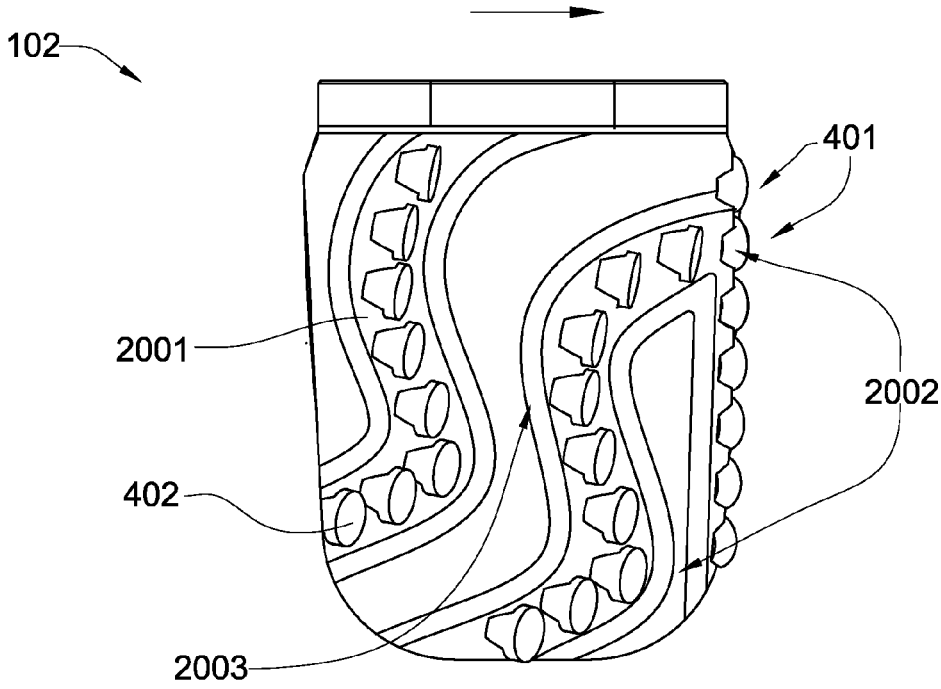
FIG. 21 is a perspective view of another embodiment of a rotary degradation element.
Figure 22:
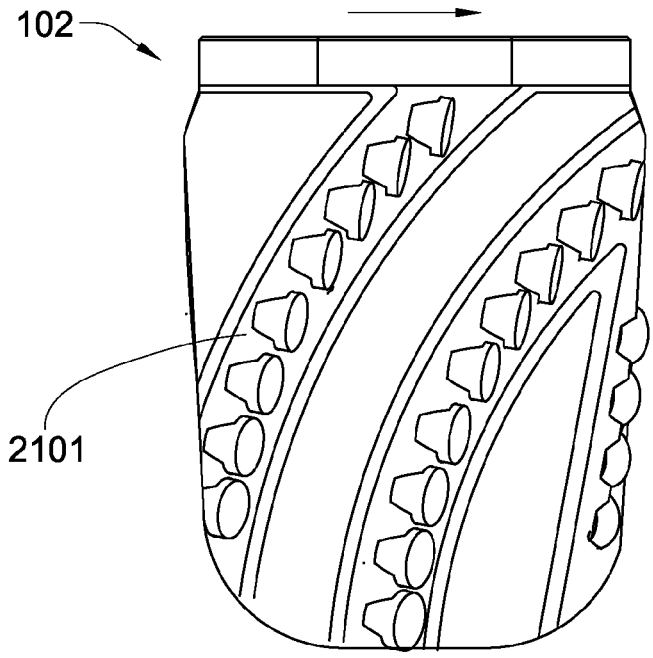
FIG. 22 is a perspective view of another embodiment of a rotary degradation element.
Figure 23:
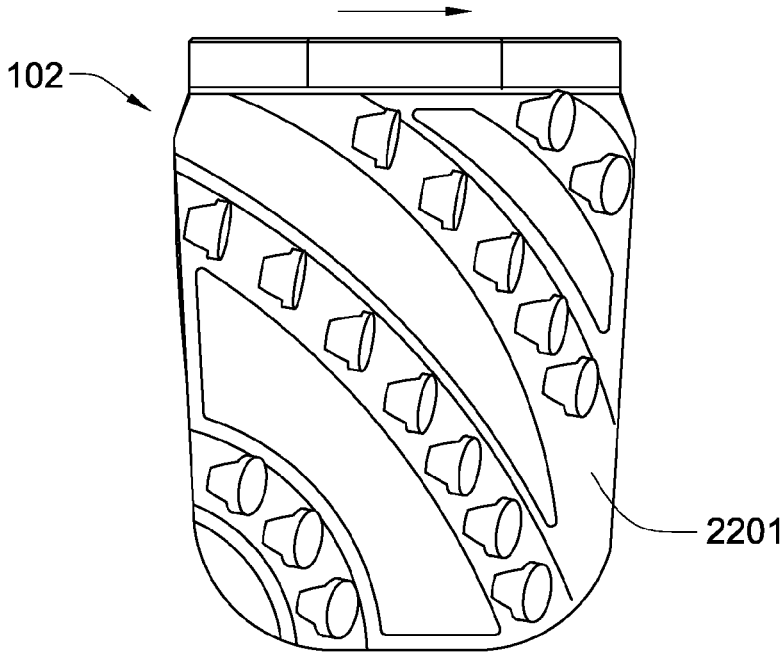
FIG. 23 is a perspective view of another embodiment of a rotary degradation element.

FIGS. 21-23 are perspective views of embodiments of a rotary degradation element's blades 403. An S-curve blade 2001 is disclosed in FIG. 21 rotating in the direction indicated by the arrow 2000. The S-curve blade 2001 may also rotate opposite the direction indicated by arrow 2000. Furthermore, at least a portion of the blade 403 may be concave or convex with respect to a direction of rotation. The element 102 in FIG. 22 comprises concave blades 2101 and the element 102 in FIG. 23 comprises convex blades 2201.

Figure 24:
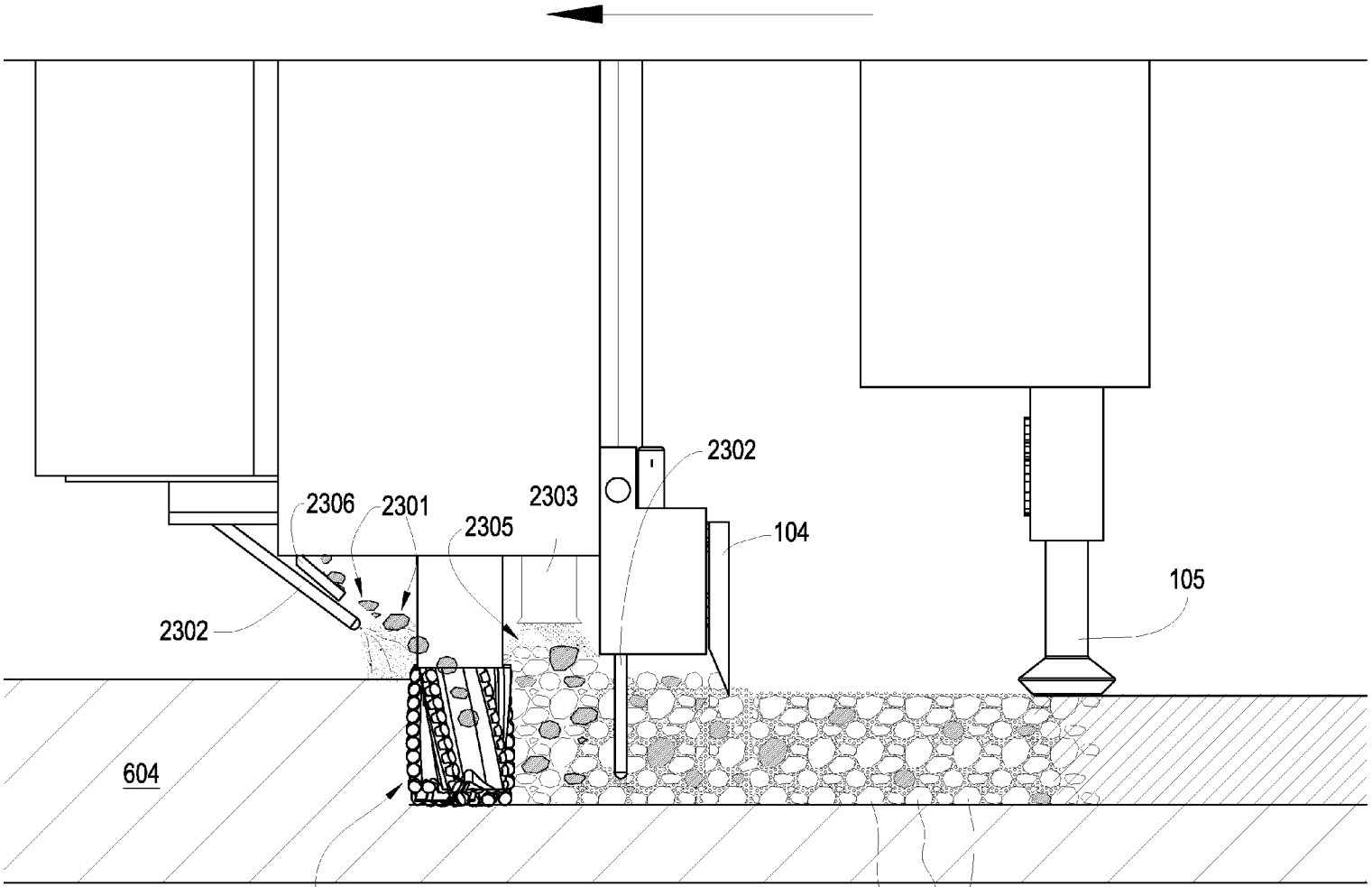
FIG. 24 is a perspective view of a rotary degradation element working in conjunction with other tools to recycle asphalt pavement in situ.

FIG. 24 is a perspective view of a rotary degradation element working in conjunction with other tools to recycle asphalt in situ. As the rotary degradation element 102 engages the pavement 604, the aggregate 603 may be dislodged from the binder. New aggregate 2301 may be dispensed from the hopper 111 through a chute 2306 so that it falls between elements 102 and is mixed with the older aggregate. Rejuvenation materials may be applied by a nozzle 2302 that sprays or fogs the rejuvenation materials between the elements 102.

The process of dislodging the aggregate 603 may create fine particles 2305 that may be removed by a vacuum 2303 comprising filters so that only certain sizes of particles are removed. Removed particles 2303 may be reintroduced into the mix if needed. Another nozzle 2302 may also be placed behind the elements 102 to plunge into the mix and dispense rejuvenation materials which may help stir the aggregate and rejuvenation materials as well as helping to coat the aggregate 603, 2301.

Figure 25:
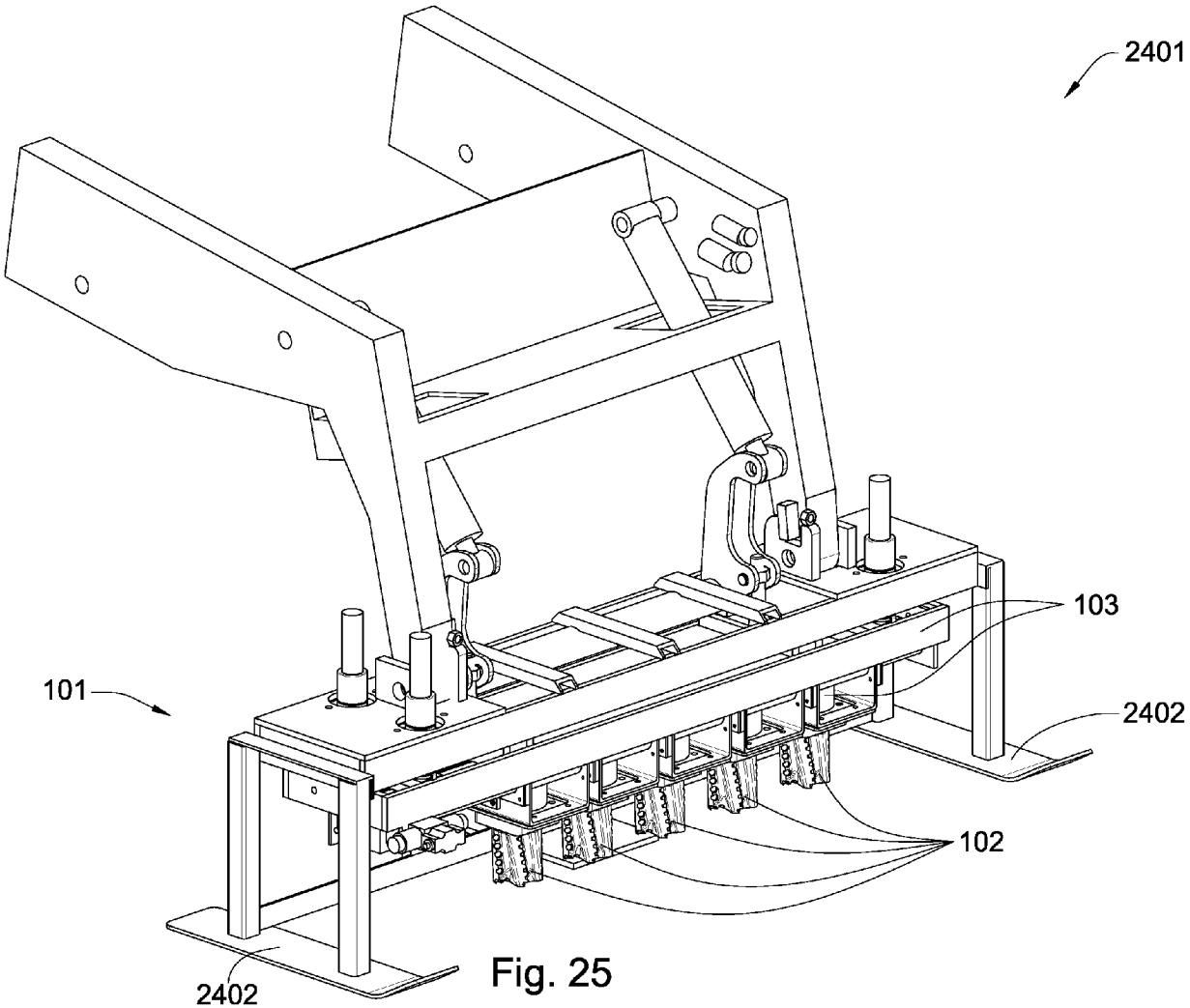
FIG. 25 is a perspective view of a component of a motorized vehicle connected to rotary degradation elements.

FIG. 25 is a perspective view of a component 2401 of the motorized vehicle connected to rotary degradation elements 102. The component 2401 may comprise a carrier 101 connected to an underside 150 of the component 2401. Such a component 2401 may be disposed at the front, side of back of the motorized vehicle.

The component 2401 may comprise skis 2402 that may help stabilize the component while the elements 102 engage the pavement 604. Such a component may allow a smaller vehicle than the motorized vehicle shown in FIG. 1. to degrade pavement that the larger motor vehicle may not reach be able to reach.

Figure 26:
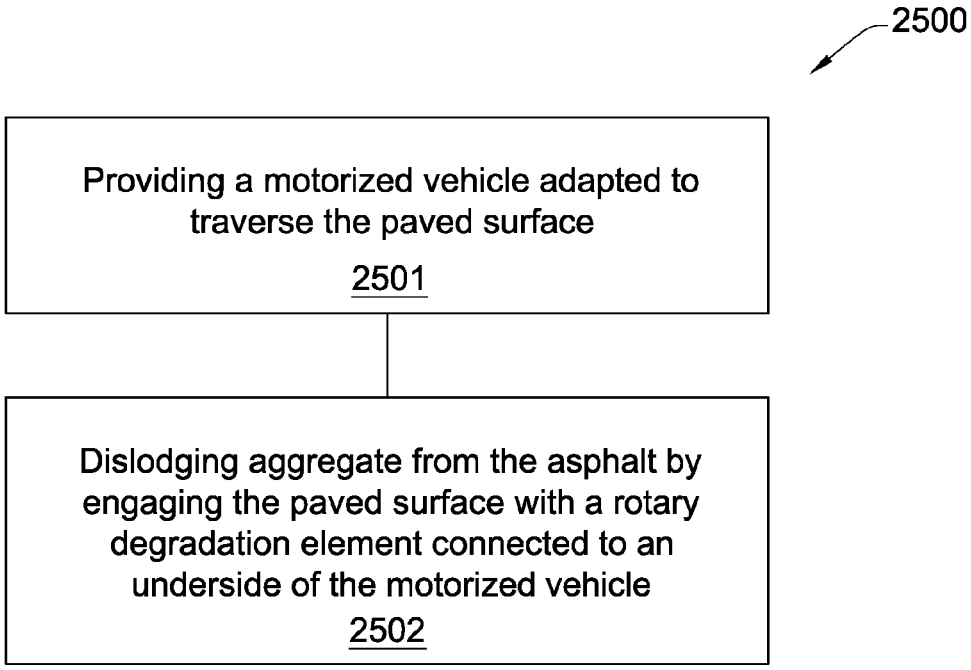
FIG. 26 is a schematic of a method for degrading a paved surface.

FIG. 26 is a schematic of a method 2500 for degrading a paved surface. The method 2500 may comprise the steps of: providing 2501 a motorized vehicle adapted to traverse a paved surface and dislodging 2502 aggregate from the asphalt by engaging the paved surface with a rotary degradation element connected to an underside 150 of the motorized vehicle, the rotary degradation element comprising an axis of rotation substantially non-parallel to the paced surface.

Figure 27:
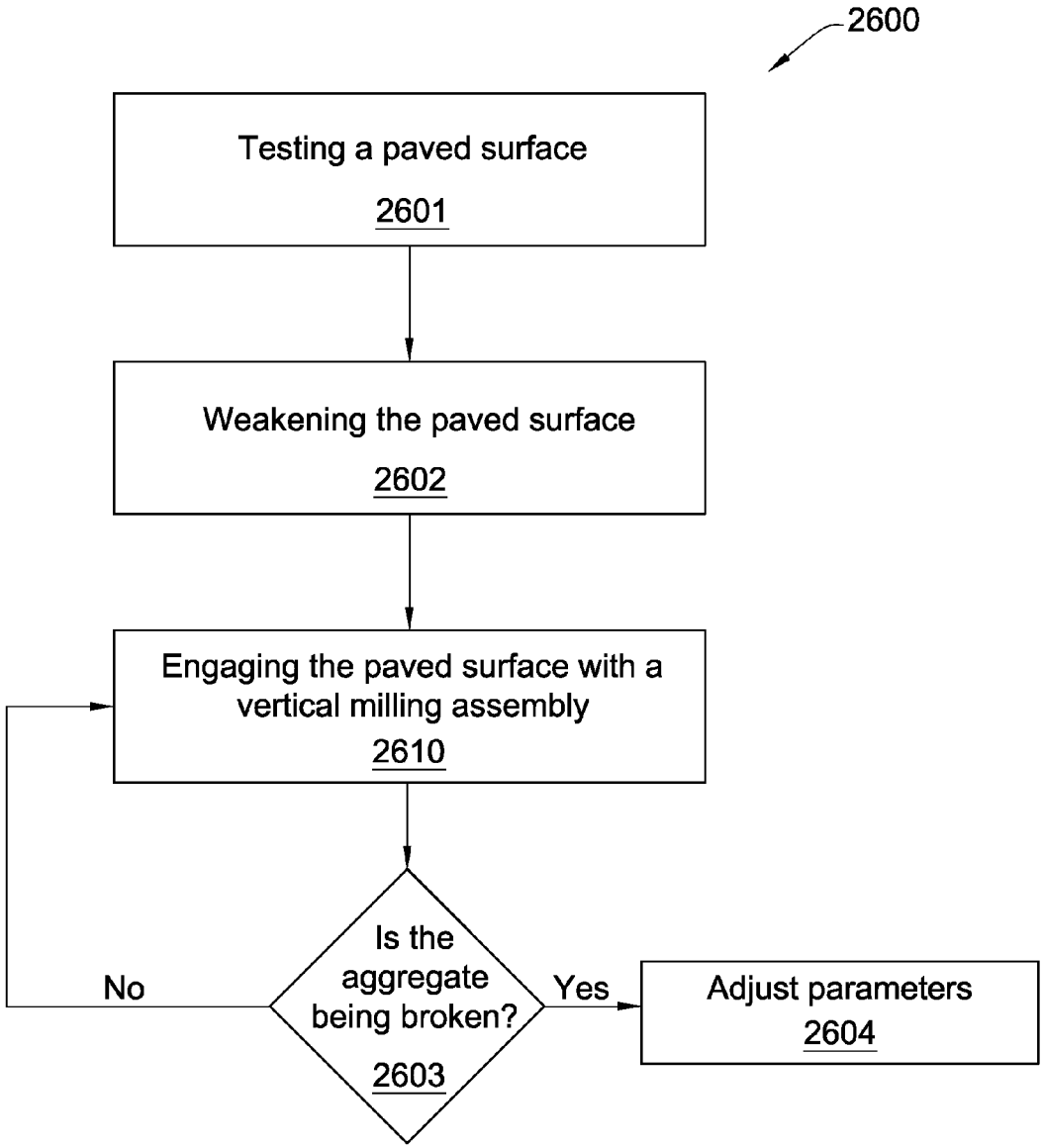
FIG. 27 is a schematic of another embodiment of a method for degrading a paved surface.

FIG. 27 is a schematic of another embodiment of a method 2600 for degrading a paved surface. A paved surface may first be tested 2601 by taking core sample or engaging 2610 the paved surface and stopping to check if aggregate is being broken. This may be sensed electronically while the element is degrading the pavement, afterwards or combinations thereof. Prior, during or after testing 2601 is completed, the pavement may be weakened 2602. Though perhaps not necessary, weakening 2602 pavement may be beneficial in reducing the strength of the bond between the aggregate and an asphalt binder. Weakening 2602 may comprise the step of heating the asphalt prior to the step of dislodging. When sufficiently weakened 2602, a vertical milling assembly may engage 2610 the paved surface; the assembly may comprise at least one insert which may be bonded to a rotary degradation element and may comprise a superhard working surface positioned to angularly contact the paved surface at an incline. The method 2600 may further include a step of controlling the efficiency at which the rotary degradation elements 102 degrade the paved surface. While engaging 2610, this step may be performed by a person or electronic device checking 2603 if the aggregate is being broken. If the aggregate is being broken, efficiency may be controlled by modifying 2604 parameters such as rotational speed of the rotary degradation element, the motorized vehicle's traversing speed, the incline and/or geometry of at least one insert, the temperature, or combinations thereof. If the aggregate is not being broken, then the engaging 2610 may continue without adjusting the parameters. In some embodiments, the a first portion of the aggregate is removed after the step of dislodging while a second portion is left, wherein an average sized aggregate of the first portion is smaller than an average sized aggregate of the second portion. This may be accomplished by using a vacuum which sucks up fine particles of the old pavement. A filter may be used to prevent the larger aggregate from being removed.

What is claimed is:

1. A vertical milling assembly for a paved surface, comprising:

a rotary degradation element comprising a top end connected to a carrier which is slideably attached to an underside of a motorized vehicle, and adapted to traverse the paved surface; and the rotary degradation element comprising an axis of rotation non-parallel with the paved surface and a plurality of inserts secured to the element's outer surface comprise at least one superhard working surface positioned to contact the paved surface;

at least one insert comprising a superhard working surface positioned to angularly contact the paved surface at an incline;

wherein the inserts are secured to a plurality of blades formed in the outer surface of the rotary degradation element and a trough is formed intermediate the blades; and wherein the rotary degradation element is also adapted to degrade the paved surface in a direction of travel of motorized vehicle.

2. The apparatus of claim 1, wherein the working surface is adapted to angularly contact the paved surface at a negative rake.

3. The apparatus of claim 2, wherein the negative rake is from 0.1° to 60°.

4. The apparatus of claim 1, wherein the rotary degradation element is attached to the carrier by a shaft substantially coaxial with its central axis.

5. The apparatus of claim 1, wherein the rotary degradation element is adapted to degrade the paved surface in a direction substantially normal to the paved surface.

6. The apparatus of claim 1, wherein the axis of rotation is substantially perpendicular to the paved surface.

7. The apparatus of claim 1, wherein the superhard working surface is flat, rounded, chamfered, polished, or combinations there of.

8. The apparatus of claim 1, wherein the insert comprises a superhard working surface bonded to a substrate at a non-planar interface.

9. The apparatus of claim 1, wherein the superhard working surface comprises a region leached of binder-catalyzing material.

10. The apparatus of claim 1, wherein the rotary degradation element is in communication with an actuating mechanism adapted to move the rotary degradation element in an horizontal, vertical, transverse, diagonal and pivotal direction relative to the motorized vehicle.

11. The apparatus of claim 1, wherein an axis formed by at least a portion of the blade is offset from the axis of rotation by an angle from 1 to 60 degrees.

12. The apparatus of claim 11, wherein the offset tilts with or against a direction of rotation.

13. The apparatus of claim 1, wherein at least a portion of the blade is concave or convex with respect to a direction of rotation.

14. The apparatus of claim 1, wherein at least one of the inserts is positioned on an anterior side of the blade and another insert is positioned on a posterior side of the blade.

15. The apparatus of claim 1, wherein a shield comprises a first end attached to the carrier and a second end is proximate the rotary degradation element.

16. The apparatus of claim 1, wherein the rotary degradation element comprises a shape that is generally cylindrical, conical, pyramidal, rectangular, frustoconical, domed, or combinations thereof.

17. The apparatus of claim 1, wherein the trough is closed at the top end.

18. The apparatus of claim 1, wherein at least one insert is positioned in a bottom end of the rotary degradation element where a plurality of blades converge.

19. The apparatus of claim 1, wherein the superhard working surface comprises polycrystalline diamond, vapor deposition diamond, natural diamond, or cubic boron nitride.

20. A method for vertically milling a paved surface, the method comprising:

providing a motorized vehicle adapted to traverse the paved surface;

dislodging aggregate from the asphalt by engaging the paved surface with a plurality of inserts secured to a plurality of blades formed in an outer surface of a rotary degradation element connected to an underside of the motorized vehicle, the rotary degradation element comprising an axis of rotation substantially non-parallel to the paved surface and a plurality of troughs are formed intermediate the blades; and traversing the paved surface with the motorized vehicle such that the paved surface is substantially degraded in a direction of travel of the motorized vehicle.

21. The method of claim 20, further comprising the step of heating the asphalt prior to the step of dislodging.

22. The method of claim 20, wherein at least one insert is bonded to the rotary degradation element and comprises a superhard working surface positioned to angularly contact the paved surface at an incline.

23. The method of claim 20, wherein the method further includes a step of controlling the efficiency at which the rotary degradation elements degrade the paved surface.

24. The method of claim 23, wherein the step of controlling the efficiency includes modifying a rotational speed of the rotary degradation element, modifying a traversing speed of the motorized vehicle, modifying an incline and/or geometry of at least one insert, temperature, or combinations thereof.

25. The method of claim 20, wherein a first portion of the aggregate is removed after the step of dislodging while a second portion is left, wherein an average sized aggregate of the first portion is smaller than an average sized aggregate of the second portion.

* * * * *